United States Patent [19]

Estabrooks

[11] Patent Number: 4,493,568

[45] Date of Patent: Jan. 15, 1985

[54] DOT MATRIX PRINTHEAD EMPLOYING MOVING COILS

[76] Inventor: David A. Estabrooks, 6 Abbot Bridge Rd., Andover, Mass. 01810

[21] Appl. No.: 447,486

[22] Filed: Feb. 22, 1983

[51] Int. Cl.[3] ..... B41J 3/12

[52] U.S. Cl. ..... 400/124; 101/93.05; 400/121

[58] Field of Search ..... 101/93.04, 93.05, 93.48; 400/121, 124, 119, 470-471.1

[56] References Cited

U.S. PATENT DOCUMENTS

| | | | |
|---|---|---|---|
| 3,072,045 | 6/1963 | Goin | 101/93.29 |
| 3,087,421 | 4/1963 | Irwin et al. | 101/93.29 |
| 3,172,352 | 3/1965 | Helms | 101/93.29 |
| 3,172,353 | 3/1965 | Helms | 101/93.29 |
| 3,209,681 | 10/1965 | Sanborn | 101/93.04 |
| 3,279,362 | 10/1966 | Helms | 101/93.29 |
| 3,279,364 | 10/1966 | Helms | 101/93.29 |
| 3,282,203 | 11/1966 | Kalbach et al. | 101/93.33 |
| 3,285,166 | 11/1966 | Helms et al. | 101/93.29 |
| 3,643,595 | 2/1972 | Helms et al. | 101/93.29 |
| 3,971,311 | 7/1976 | Deproux | 101/93.04 |
| 4,022,311 | 5/1977 | Krull | 400/124 X |
| 4,114,532 | 9/1978 | Arzoumanian | 101/93.48 |
| 4,129,390 | 12/1978 | Bigelow et al. | 101/93.48 X |
| 4,194,846 | 3/1980 | Zerillo | 400/471.1 X |
| 4,211,493 | 7/1980 | Costello et al. | 400/121 |
| 4,269,118 | 5/1981 | Jezbera | 101/93.34 |
| 4,279,521 | 7/1981 | Kightlinger | 101/93.05 X |
| 4,288,167 | 9/1981 | Carson, Jr. et al. | 101/93.04 X |
| 4,348,119 | 9/1982 | Carson, Jr. et al. | 400/121 |
| 4,349,283 | 9/1982 | Sapitowicz et al. | 400/124 |

FOREIGN PATENT DOCUMENTS

| | | | |
|---|---|---|---|
| 67327 | 6/1977 | Japan | 400/119 |

*Primary Examiner*—Paul T. Sewell

*Attorney, Agent, or Firm*—Louis Weinstein

[57] ABSTRACT

Printing apparatus of the dot matrix type comprising a plurality of print wire actuators employing moving coils. The wire printing tip of each actuator is activated by the coil magnetic field interacting with an efficiently applied magnetic field substantially perpendicular to the direction of current flow in the coil. The actuator comprises a thin planar lamination having low inertia and high heat dissipation for balanced pivotal motion to provide high speed letter quality printing and high resolution graphics.

26 Claims, 16 Drawing Figures

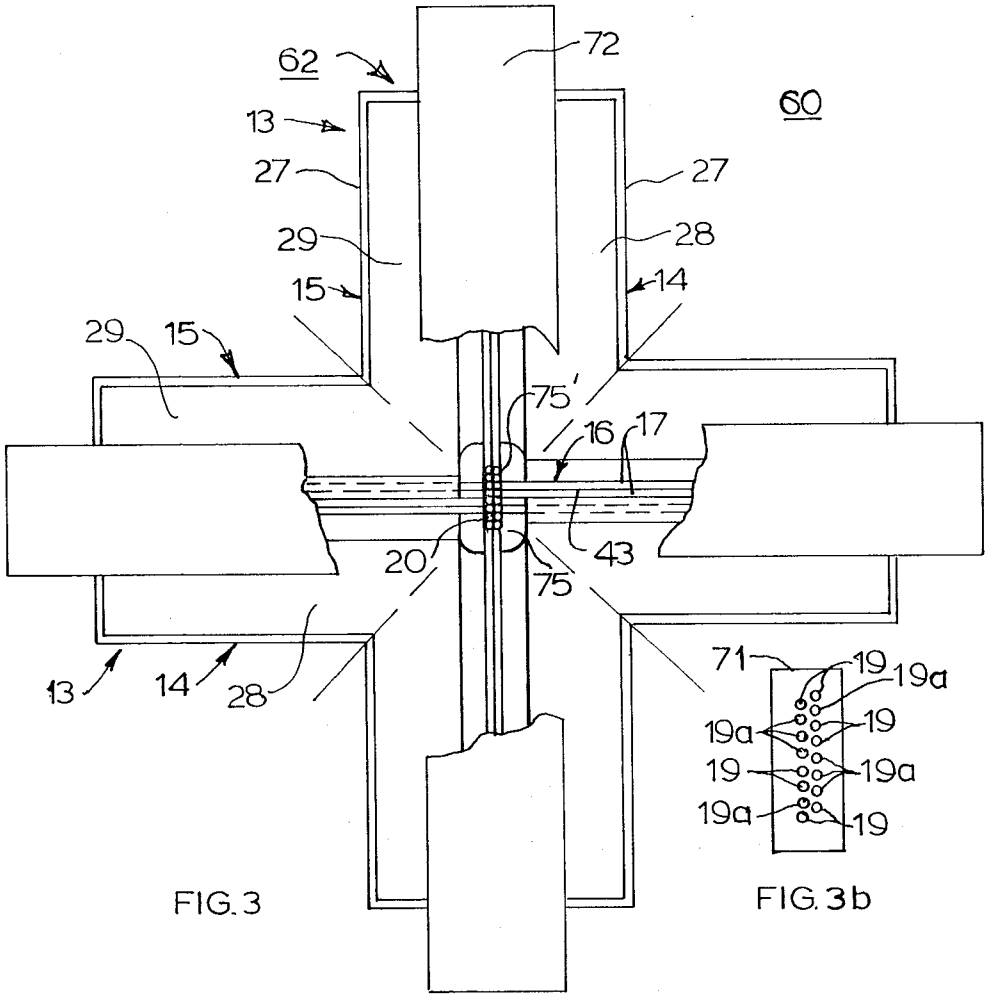
FIG. 3b
FIG. 3
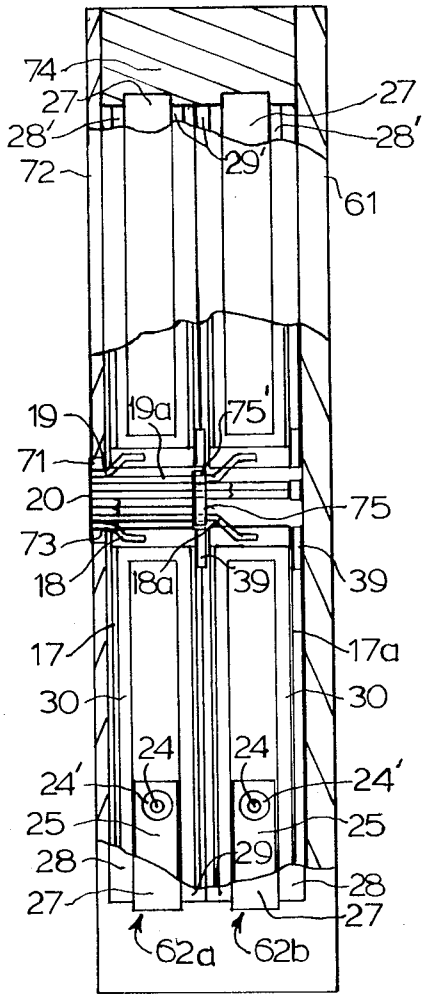
FIG. 3a

DOT MATRIX PRINTHEAD EMPLOYING MOVING COILS

BACKGROUND OF THE INVENTION

Dot matrix print heads of the impact type are well known and are widely used in computer printers. They are generally comprised of a plurality of print wires each driven by a solenoid. The wires are typically of the ballistic type, being propelled in free flight by an impulse force directly proportional to the coil current and the magnetic field strength. The impulse force must propel the wire to the required velocity and kinetic energy to preferably print ink dots on multiple sheets of paper. Print wires are typically slender and must be supported to prevent buckling. The wires are arranged with adequate supporting guides to merge towards the front to form a closely packed array of printing tips aligned by a nose bearing in a matrix of inline or staggered rows and columns.

After printing the selected dots in each column, or vertical straight line, the printhead mounted on a carriage is stepped either discretely or continuously to the next horizontal printing position. Correspondence quality print and graphics are produced by multiple traversing of the printhead while selectively impulsing combinations of print wires. It is typical to print using a head comprising a single or double column of seven to nine wires. However, three staggered columns of eight fine wires are typically required for producing letter quality print and high resolution graphics in a single traverse. Using smaller diameter print wires enables more effectively overlapping the dots without having the edges of the characters give a ragged appearance so as to affect the print quality.

Because of the high resolution printing capability with computer software control, the dot matrix printing concept can provide the desired flexibility not possible with fully-formed character printing. However, dot matrix printheads typically must print more slowly as the dot density or the graphic resolution is increased to enhance print quality.

Conventional dot matrix printheads tend to be speed limited because of the large mass or inertia of the print wire mechanism coupled with the difficulties of dissipating heat and the long response time of solenoid devices.

Presently, moving coil printhead actuator designs are also speed limited and may rely on pulse damping to prevent backstop rebound. The actuators are generally thin and planar but with some mass and stiffness, and may have a copper coil formed on an insulating substrate. These low cost printheads generally comprise seven to nine actuators closely stacked in parallel planes in one primary magnetic flux gap with the actuator printing tips disposed along a common line.

Heat transfer from the coils to the magnet heat sink area tends to be markedly decreased when more than about three actuators are closely stacked in parallel planes. Difficulties in adequately dissipating the heat generated tends to impose limitations on this design configuration. Substrate coil forms are not densely packed and interact less effectively with the magnetic flux in the air gap. Magnetic field strength is lower in one more widely spaced air gap.

Whenever magnetic field strength is decreased, or coil interaction is less effective, or actuator mass is increased, a larger coil current is required to obtain the necessary kinetic energy and velocity for printing. The heat that must be dissipated is directly proportional to the square of the current. With a lesser heat transfer capability the allowable maximum operating temperature is reached at a lower current level. This further limits speed and performance.

Moving coil dot matrix actuators have the potential for achieving high speeds provided the actuator mass and support stiffness is small, the coil inductance is low, the heat dissipation is adequate, and the magnetic circuit is cost effectively optimized to achieve the highest possible flux density in the air gap. Optimizing the quantity of high energy permanent magnetic material in the circuit requires the design to operate at the flux density where the available external energy is at a maximum, or the peak energy product of the magnetizing force of the magnet and the flux density of the magnet.

A large number of computer data and word processing applications exist where it is very desirable to have a fast versatile, cost effective printer that has the capability of producing both high resolution graphics and letter quality documents.

BRIEF DESCRIPTION OF THE INVENTION

The present invention is characterized by providing an efficient, cost effective dot matrix moving coil printhead comprising a plurality of magnetic element sets. Each set has a high flux density gap containing one or more high torque to inertia ratio print wire actuators immersed in a ferromagnetic fluid to provide adequate heat dissipation for performing at high speeds. The sets are arranged to align all of the actuator print wire tips adjacent to each other and along at least one common line. The wire tips are supported and precisely guided by a nose bearing.

Each actuator has a friction free resilient support, and the ferromagnetic fluid has preferably a low viscosity but a large heat transfer coefficient. The coil is tightly wound with turns maximized to interact effectively with the high flux density in the magnetic gap made narrow to minimize leakage flux. Each magnetic element set is optimized to operate at the peak energy product of the high energy permanent magnetic material which is effectively located near the actuator coils to further increase gap flux density.

The frequency response of the actuators is maximized by minimizing the mass and the coil inductance, and reducing the actuator resilient support stiffness to a small optimum value to minimize stored spring energy while providing for adequate structural strength and the biasing of the actuator toward a return damper backstop at a non-print position.

Preferably the value of the support mechanical stiffness is made small enough so that the frequency response varies directly with the magnetic flux density in the gap and inversely with the actuator mass and coil inductance. The "stiffness" and damping of the actuator is provided by the electromagnetic coupling between the coil magnetic field and the fixed magnetic flux in the gap. This coupling and the low viscosity ferromagnetic fluid retained in the gap provides underdamped motion of the actuator and tends to discourage rebound at the actuator backstop.

The present invention is characterized by having a configuration which is in complete force balance or dynamic equilibrium. In the preferred embodiments, the print wire actuator performs pivotal motion such that the printing tip is positioned at the center of percussion with respect to the supporting pivotal axis of the actuator. Dynamic equilibrium results with zero reaction force at the supporting axis.

In the preferred embodiments, the actuator is thin and planar having low mass and comprising a flat and generally rectangular coil having low inductance. Each set of magnetic elements is spaced apart to form a slot-shaped gap. The actuator pivotal support is resilient, providing for friction-free rotational motion of the actuator. The electrical current to the coil is provided by a pair of flat flexual members disposed in the actuator plane between the coil and the support base.

The preferred embodiments are further characterized by having groups of magnetic element sets disposed parallel to one another with the sets in each group arranged in a common plane. All of the element sets in the printhead are arranged in a general radial array about the closely packed printing tips. The tips are aligned in a matrix of rows and columns with the columns extending transversely of the direction of a line to be printed. The slot-shaped flux gaps are aligned parallel with the print wires, and the actuators in each gap are stacked parallel to one another. The gaps of adjacent sets are equally angularly spaced from one another. Each actuator has a backstop functioning as a return damper at the non-print position.

In one preferred embodiment, a single group of four sets are arranged in one common plane with the slot-shaped gaps spaced perpendicular to one another and having two actuators in each gap. The printhead comprises eight short print wires having the same general length.

In another preferred embodiment, the magnetic assembly comprises two parallel groups, each comprising four sets, with one group disposed further from the printing tips. The adjacent slot-shaped gaps of each group are spaced perpendicular to one another, and the gaps of one group are parallel to the gaps of the other group. Two print wire actuators are in each gap with a total of sixteen wires in eight rows and two vertical columns. The rows may be staggered for printing overlapping dots.

In still another preferred embodiment, each of four groups comprises a pair of magnetic element sets. The groups are parallel and adjacent to one another and have all eight slot-shaped gaps in one common plane. Successive ones of the four groups are located progressively further from the printing tips. Three print wire actuators are arranged in each gap with a total of twenty-four fine wire printing tips in a matrix of eight rows and three vertical columns. The rows of print wires are offset from each other vertically by one-half wire diameter to print overlapping dots. Utilizing two actuators per gap there are a total of sixteen print wires, and with one actuator per gap a total of eight print wires.

As an alternative to the conventional ink ribbon, a magnetic circuit is easily utilized in any of these embodiments of retain magnetic ink at the printing tips.

BRIEF DESCRIPTION OF THE FIGURES AND OBJECTS OF THE INVENTION

It is therefore one object of the present invention to provide unique dot matrix apparatus employing moving coils.

A further object of the present invention is to provide a high speed, versatile, cost effective printhead having the capability for producing both high resolution graphics and letter quality documents.

Another object of this invention is to provide a dot matrix printhead having particular utility in a word processor with the capability for printing fully-formed characters in a single horizontal pass of the printhead.

Still another object of this invention is to provide a modular printhead which is vertical, thin and flat for use in side-by-side, multiple-cartridge arrays with the capability for printing full-color, high resolution graphics in a single horizontal pass of the printhead.

The foregoing and other objects, features, and advantages of the invention will become apparent from the following more particular description of the preferred embodiments of the invention, as illustrated in the accompanying drawings in which:

FIGS. 1 and 1*a* show simplified front elevational and partially sectionalized side views, respectively, of an eight wire moving coil printhead.

FIGS. 2*a*, 2*b*, and 2*c* show detailed side, front, and top views, respectively, of two moving coil print wire actuators contained in the narrow slot-shaped flux gap of one set of magnetic elements of FIG. 1 and typical of the actuators in the other preferred embodiments.

FIGS. 3 and 3*a* show partially sectionalized front elevational, and side views, respectively, of a sixteen wire print head used primarily for correspondence quality and high resolution graphics printing.

FIG. 3*b* is a front elevational view of a portion of the printhead nose bearing of FIG. 3 and showing the relationship of all the printing tips of the print wires.

FIGS. 4 and 4*a* show simplified front elevational and partially sectionalized side views, respectively, of a vertical, thin and flat modular printhead used for multiple arrays.

FIG. 4*b* is a front elevational view of the nose bearing of a sixteen wire printhead of FIG. 4 and showing the relationship of all the printing tips of the print wires.

FIG. 4*c* is a front elevational view of the nose bearing of a twenty-four wire printhead of FIG. 4 and showing the relationship of all the printing tips of the print wires.

FIG. 5 is an end view of a magnetic element set at the front end of the printhead of FIG. 4 and shows a sectionalized side view of an additional magnetic circuit attached at the front of the nose bearing for retaining magnetic ink at the printing tips.

FIGS. 5*a* and 5*b* show detailed front and top views, respectively, of the magnetic circuit of FIG. 5 for retaining ink at the printing tips.

FIG. 5*c* shows the manner in which the printhead of FIG. 4 is arranged relative to a platen and a paper web.

DETAILED DESCRIPTION OF THE INVENTION

FIGS. 1, 2, 3, and 4, show printheads designed in accordance with the principles of the present invention. For purposes of simplicity, the printers in which any of the printheads are mounted and the driving and control means for the horizontal positioning of the printheads have been eliminated. However, it should be understood that the dot matrix electromagnetic printing apparatus of the present invention such as apparatus 80 shown in FIG. 5*c*, is movable across a paper web W supported by a platen and may be utilized for printing either uni-directional or bi-directional horizontal passes across the paper web with selected combinations of print wires.

Figure 1:
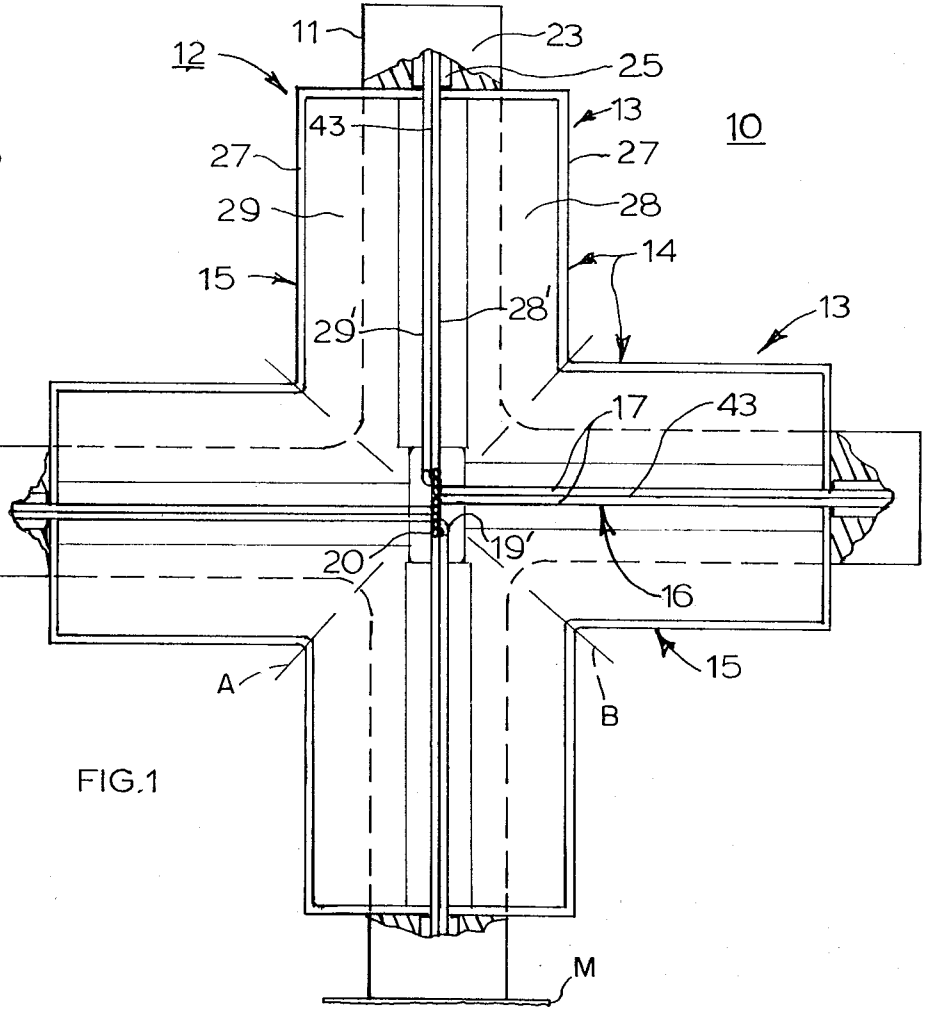
Figure 1A:
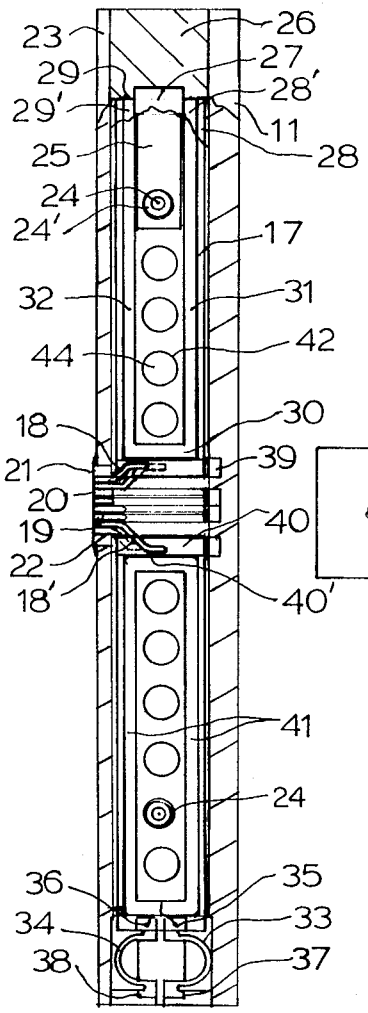

The printhead 10 is comprised of a support base 11 having a magnetic assembly 12 mounted thereon as shown in FIGS. 1 and 1*a*. Characteristic of all of the preferred embodiments of this invention, the assembly 12 is comprised of at least one group of a plurality of magnetic element sets 13 located in a common plane parallel to the support base 11, which is mounted on a printer carriage (not shown). Each element set 13 comprises magnetic elements 14 and 15 of opposing polarity and spaced apart from each other to provide a slot-shaped, magnetic flux gap 16. Each flux gap 16 contains at least one thin, planar actuator 17 comprising a print wire 18 and having a printing tip portion 19 including a printing tip 20. The element sets 13 are arranged to align the printing tip portions 19 adjacent to one another and along at least one common line with the printing tips 20 supported by a nose bearing 21 (preferably a jewel or other material having a high wear resistance) having straight guide channels 22, which are closely packed in at least one column and extending transversely of the direction of a line to be printed. In addition, the magnetic element sets 13 are arranged in a general radial array about the printing tips 20 contained in the nose bearing 21, which is fixed to the face 23. The slot-shaped flux gaps 16 are aligned with the printing tip portions 19 of their corresponding planar actuators 17, which are stacked parallel to one another and pivotally supported on a fixed axle 24. The fixed axle 24 is mounted on a support arm 25 fixed to baseplate 26, which connects face 23 to the support base 11. Further, the actuator 17 is force balanced by having the printing tip 20, the impact point, positioned at the center of percussion with respect to the fixed axle 24. Establishing dynamic equilibrium of the printing tip 20 impact force in this manner, eliminates a damaging impulsive force from being exerted at the pivotal bearing means 24', which is positioned substantially coincident with the fixed axle 24.

In preferred embodiments, the flux gaps 16 or adjacent element sets 13, which may be integral as shown in FIG. 1 separated by imaginary lines A and B, are equally angularly spaced from one another. And, the elements 14 and 15 each comprise a permanent magnet segment 27 (preferably formed of low cost hard ferrite, or rare earth cobalt material for a higher energy product) sandwiched between two magnetic soft metal pole pieces 28 and 29 of opposite polarity. Pole faces 28' or 29' are located adjacent to one another in adjacent magnetic element sets 13 to eliminate opposing magnetic flux linkage between adjacent flux gaps 16. Further, the slot-shaped flux gaps 16 of element sets 13 are preferably arranged in perpendicular or opposed combinations to more easily align and closely pack all of the printing tip portions 19 along at least one common line, and also to achieve a large area of magnet segment 27 between adjacent flux gaps 16. The large area is required to produce a dense magnetic field of 8 to 13 kilogruss in flux gaps 16 to permit operation of the actuators 17 at high operating frequencies from 3500 to 6500 Hz. The magnetic assembly 12 is cost effectively designed to preferably minimize the required volume of permanent magnet segments 27, while achieving the necessary high flux density in flux gaps 16. The magnet segment 27 volume is minimized by designing the magnetic element sets 13 to operate at the magnet flux density where the available external magnet energy is at a maximum, equal to the peak energy product of the magnetizing force of the magnet and the flux density of the magnet. In addition, the magnetic flux leakage, which reduces magnet efficiency, is minimized by designing the element sets 13 with a small surface to volume ratio, a narrow flux gap 16 with a large pole face 28' or 29' area, a large magnet segment 27 area (the area perpendicular to the direction of magnetization), and a small segment 27 thickness between the pole pieces 28 and 29 respectively. Also, the magnet segments 27 are concentrated close to the pole faces 28' and 29' while extending slightly beyond the outer edges of the pole pieces 28 and 29.

The preferred embodiment of FIGS. 1 and 1*a* comprises one group of four magnetic element sets 13 equally angularly disposed in one common plane with adjacent flux gaps 16 spaced perpendicular to one another. Each flux gap 16 contains two low mass actuators 17 comprising short printing tip portions 19 or 19' having the same general length. Two actuators 17 have printing tip portions 19' which are bent to align their printing tips 20 with straight guide channels 22 of nose bearing 21. The nose bearing 21 acts both to support and guide the short print wires 18 and 18', and to prevent them from buckling under the impact of the printing tip 20 at the print position.

Each actuator 17 includes a flat and generally rectangular, current energizable coil 30. The coil comprising two longitudinal portions 31 and 32 having low inductance is linked by two opposing magnetic flux paths provided by pole faces 28' and 29'. The actuator 17 includes first and second electrically conductive flexible support members 33 and 34 which preferably comprise substantially flat semicircular springs disposed in the same plane with the actuator 17 between the coil 30 and the baseplate 26. The support members 33 and 34 have their first ends 35 and 36 secured to the actuator 17 and respectively electrically connected to the first and second terminals (not shown for purposes of simplicity) of the coil 30. The second ends 37 and 38 of the support members 33 and 34 extend into the baseplate 26 and are connected to conductors (not shown) which extend from the baseplate 26. When the coil 30 is energized, the actuator 17 moves perpendicularly to the magnetic field in a first direction toward a print position. After impact of printing tip 20, the actuator 17 returns to a non-print position in a second direction. The flexible support members 33 and 34 are positioned to maintain the deenergized actuator 17 slightly preloaded towards a return damper backstop 39 (preferably comprising an energy absorbing material with low rebound properties such as ISODAMP sold by Cabot Corporation, Indiana) at a non-print position with adequate mechanical stiffness to minimize the return time and insure the correct dynamic operation of actuator 17. Support members 33 and 34 are preferably of beryllium copper, or other material having high resistance to torsional stress, to provide good fatigue life. Ends 35 and 36 are typically soldered respectively to first and second terminals of the coil 30, which is tightly wound and effectively utilizes the volume of flux gap 16. Multi-turn coil 30 is preferably formed of copper wire having a square or rectangular cross-section. The coil 30 is typically designed with sufficient ampere-turns to provide an actuator 17 kinetic energy of 10,000 to 13,000 ergs per dot resulting in speeds from 500 to 1000 characters per second. High speed performance is enhanced by dissipating the coil 30 heat to the magnet assembly 12 using ferromagnetic fluid 41 (preferably with a low viscosity and a high heat transfer coefficient such as that sold by Ferrofluidics Corporation, Nashua, NH under the trademark FERROFLUID) containing particles retained in the flux gap 16 by the magnetic field. The fluid 41 immerses both sides of the longitudinal portions 31 and 32 of the coil 30 forming a heat conduction path to the pole faces 28' and 29' and to magnetic elements 14 and 15 thru holes 42 in actuator 17.

In a constructional model of the preferred actuator 17 shown in FIGS. 1 and 1*a* of the present invention, the print wire 18 or 18', having a diameter of 0.014 inch and preferably formed of tungsten rhenium, is secured in a slot 40' in structural member 40, which is positioned on the actuator 17 to contact the backstop 39 when the actuator 17 is in the non-print position. The actuator 17 is constructed with coil 30, wire 18 or 18', member 40, pivotal bearing means 24' (preferably formed of a plastic such as NYLON or TEFLON), and the ends 35 and 36 of flexible support members 33 and 34 all laminated together between two layers of high temperature electrical insulation, which forms the high strength planar actuator 17 having holes 42. Preferably the lamination comprises polyimide film such as KAPTON coated on the outer side with TEFLON for low friction. The film, adhesive, and laminating process is sold by the Dupont Company. Because of the excellent match of coefficient of thermal expansion with KAPTON, copper is preferably used for the coil 30, and members 33, 34, and 40. Also, the longitudinal portions 31 and 32 on both sides of the coil 30 are preferably void of KAPTON. This provides direct contact of fluid 41 with the coil 30 insulation to enhance heat transfer. The completed size of actuator 17 is generally about 0.014 inch thick and as small as 1.25 by 0.38 inch. When two or more actuators 17 are contained in a flux gap 16, as shown in FIG. 1, the actuators 17 are separated by a spacer 43. Spacer 43 is preferably comprised of KAPTON polyimide film with a TEFLON coating on both sides, also sold by the DuPont Company. Spacer 43 has holes 44 positioned in line with holes 42 in actuator 17 to transfer heat with the ferromagnetic fluid 41. In addition to transferring heat, the retention of fluid 41 by the magnetic field in the flux gap 16 both lubricates and seals out foreign particles from between the actuators 17 with bearing means 24', spacers 43, and pole pieces 28' and 29'.

Figure 2C:
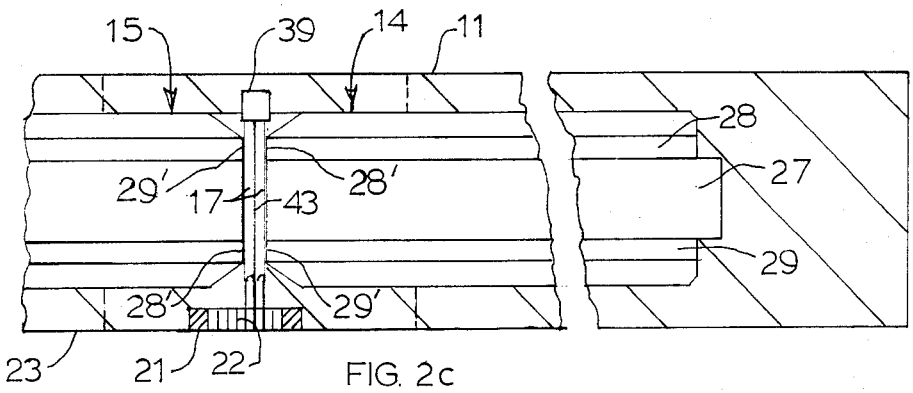
Figure 2B:
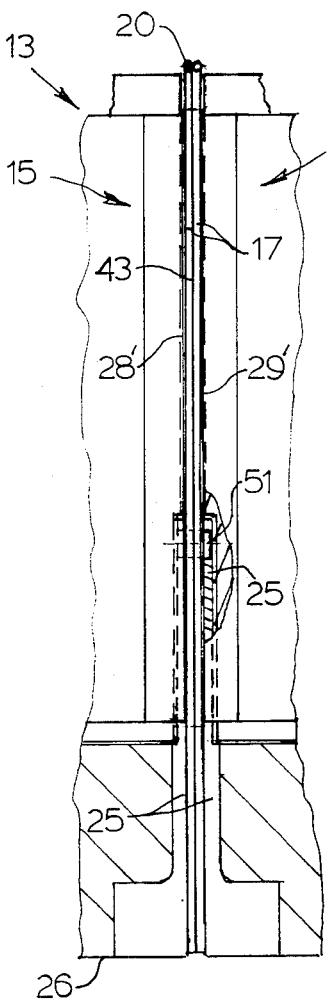
Figure 2A:
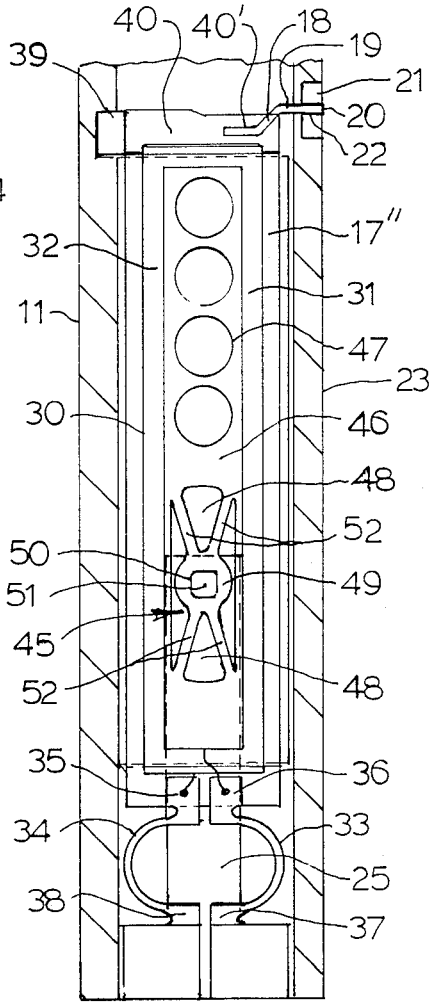

FIGS. 2*a*, 2*b*, and 2*c* show another preferred embodiment comprising actuator 17'' utilized as an equivalent of actuator 17 by the printing apparatus of the present invention. This embodiment modifies the form of construction, wherein a resilient pivotal bearing means 45 comprises a coil bobbin 46 (preferably beryllium copper) which supports the coil 30. The bobbin 46, which has holes 47 aligned with holes 44 in spacer 43, includes at least one torsion spring portion 48 comprising a central hub 49 having a square hole 50 and mounted on a square axle 51, which is fixed to the support arm 25. Each torsion spring portion 48 comprises at least one flexual arm 52 connecting the bobbin 46 with the central hub 49. Each spring portion 48 is positioned longitudinally on the bobbin 46 for pivotal motion of the actuator 17'' about the fixed axle 51.

A second preferred printhead embodiment is shown in FIGS. 3, 3*a* and 3*b* comprising sixteen print wires and used preferably for correspondence quality and graphics printing. The printhead 60 has essentially the same features and functional characteristics as the printhead 10 of FIGS. 1 and 1*a* except that the magnetic assembly 62 comprises two parallel groups 62*a* and 62*b* sandwiched together, one behind the other, so that group 62*b*, which is mounted on support base 61, is diposed further from the sixteen printing tips 20. Groups 62*a* and 62*b* each have four magnetic element sets 13 with each element set 13 having a slot-shaped flux gap 16. The adjacent flux gaps 16 in each group 62*a* and 62*b* are spaced perpendicular to one another. And, the flux gaps 16 of group 62*a* which are adjacent to the flux gaps 16 of group 62*b* are parallel to one another. Group 62*a* comprises eight actuators 17, each having a print wire 18, with two actuators 17 in each flux gap 16. Group 62*b* comprises eight actuators 17*a*, differing from actuators 17 only by the longer print wire 18*a*, with two actuators 17*a* in each flux gap 16. FIG. 3*b* shows the relationship of all the printing tips 20 of print wires 18 and 18*a* respectively, and also shows that the two columns of eight print wires may be offset from one another typically by one-half of a print wire diameter. The printing tips 20 are supported by a nose bearing 71 fixed to the face 72 and having straight guide channels 73, which are closely packed in a matrix of eight rows in two columns. The support arms 25 are fixed to the baseplate 74, which connects face 72 to support base 61. Partition 75 guides and supports the longer print wires 18*a* with passages 75' to prevent the printing tip portions 19*a* from buckling under the impact of printing tips 20 at the print position. Partition 75 is preferably formed of a plastic such as DELRIN.

Figures 4, 4A, 4B, 4C, 5, 5A, 5B, 5C:
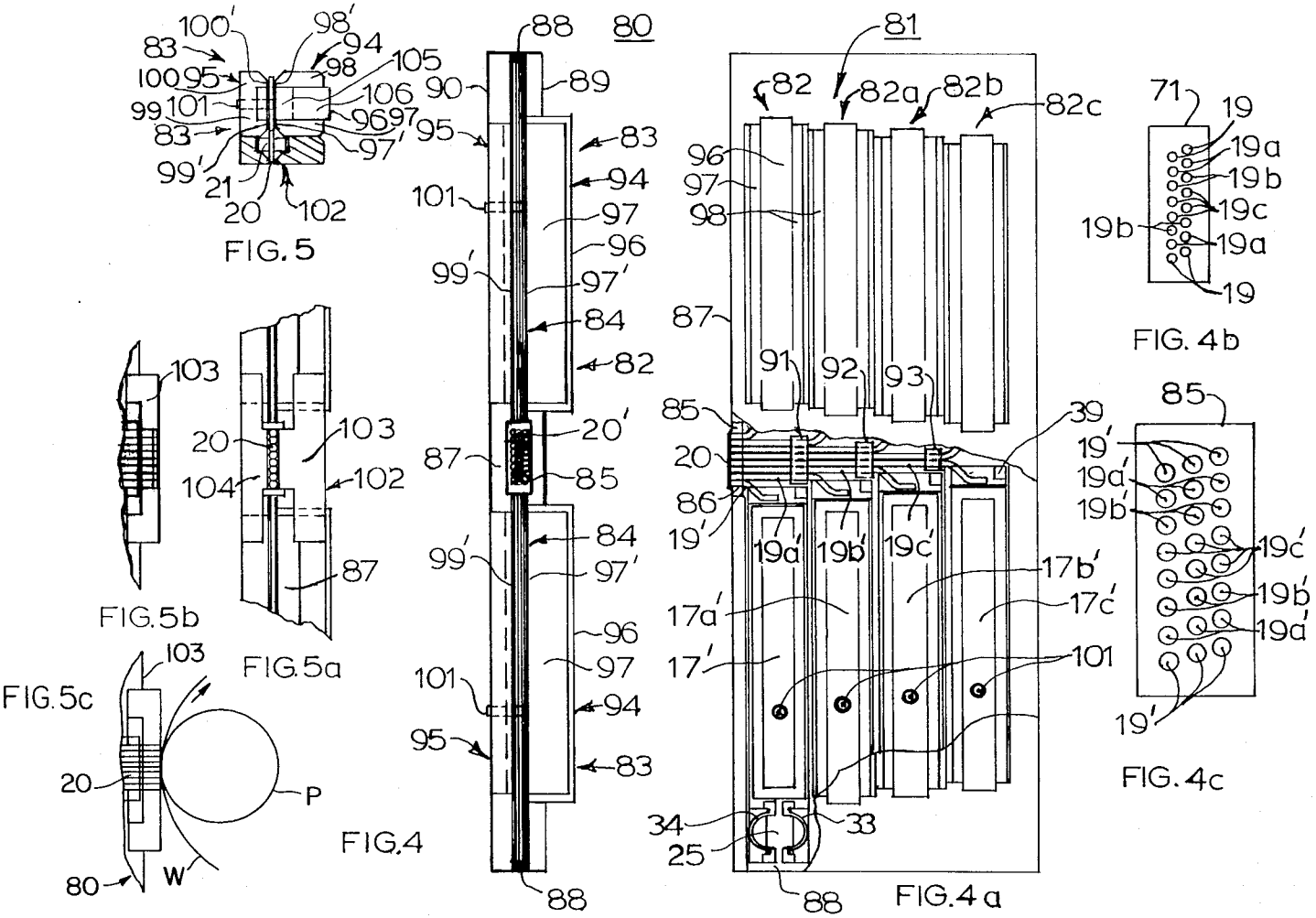

Still another preferred embodiment is shown in FIGS. 4 and 4*a* comprising up to twenty-four small diameter (preferably 0.008 inch tungsren rhenium) print wire tips 20' for printing letter quality word processing and high resolution graphics in a single pass. The printhead 80 has essentially the same characteristics as printhead 10 and 60 except that the magnetic assembly 81 comprises four groups 82, 82*a*, 82*b*, and 82*c* respectively, with each group comprising a pair of magnetic element sets 83 aligned opposite one another in a radial array. The four groups are arranged parallel and adjacent to one another with all eight slot-shaped flux gaps 84 in one common plane. Successive ones of the four groups 82, 82*a*, 82*b*, and 82*c* respectively (their respective flux gaps 84 each containing three print wire actuators 17', 17*a'*, 17*b'*, and 17*c'* respectively) are disposed progressively further from the twenty-four printing tips 20'. (An alternative embodiment of printhead 80 may be utilized with each respective flux gap 16 containing two actuators 17, 17*a*, 17*b*, and 17*c* respectively. FIG. 4*b* shows the relationship of the sixteen printing tips 20 of the respective print wires 18, 18*a*, 18*b*, and 18*c* in two offset columns of eight printing tips 20.) FIG. 4*c* shows the relationship of the twenty-four printing tips 20' of print wires 18', 18*a'*, 18*b'* and 18*c'* respectively. The printing tips 20' are disposed in a matrix of eight rows in three columns supported by the guide channels 86 of nose bearing 85, which is fixed to face 87. The columns are preferably vertically offset 0.005 inch from each other with 0.015 inch spacing between all of the printing tips 20'. Dots printed with printing tips 20' and an ink ribbon are generally 0.010 inch diameter. The printhead 80 is preferably translated, equivalent to 0.005 inch increments, to print overlapping dots at 0.005 inch increments both horizontally and vertically, thereby achieving letter quality and high resolution graphics in one press of the printhead 80. The baseplate 80 is fixed to the face 87 and mounted between side walls 89 and 90, which support partitions 91, 92, and 93. The partitions 91, 92, and 93, having passages 91', 92' and 93' respectively, support and guide print wires 18*a'*, 18*b'* and 18*c'* respectively to prevent the printing tip portions 19a', 19b', and 19c' respectively, from buckling under the impact experienced by printing tips 20' at the print position. Magnetic element sets 83 mounted on side walls 89 and 90 as shown in FIGS. 4 and 4a comprise elements 94 and 95. Element 94 comprises a permanent magnet segment 96 sandwiched between two pole pieces 97 and 98 of opposite polarity, having respective pole faces 97' and 98'. As with the other preferred embodiments, magnet segments 96 preferably comprise rare earth sarmarium cobalt, mischmetal, or lower cost hard ferrite. Element 95 comprises preferably a soft magnetic member having pole piece portions 99 and 100 of opposite polarity, which have respective pole faces 99' and 100'. Pole faces 99' and 100' are of opposite polarity to pole faces 97' and 98' respectively. Print wire actuators 17, 17a, 17b and 17c, shown in FIG. 4, are each supported for pivotal motion on a fixed axle 101 mounted on element 95, which functionally replaces support arm 25 shown in FIGS. 1a, 2a and 2b.

In preferred embodiments, magnetic element set 83, shown in FIGS. 4 and 5, having one magnet segment 96 is an alternative to the element set 13 type of design having two magnetic segments 27 as shown in FIG. 1. In either type of design, magnetic segment 27 or 96 preferably has a large cross-sectional area, is short or thin and can be located close to the coil 30 to greatly reduce the flux leakage path. Short magnets, such as rare earth cobalt or hard ferrite, have a high magnetomotive force (m.m.f. is equal to the product of the unit magnetizing force and the length of the magnet) per unit length.

Hard ferrite magnets are readily available and are less expensive than rare earth magnets, and although their residual induction is lower, this property is overcome by enlarging the area of the magnet cross-section. A cost effective alternative design for magnet segment 27 or 96 comprises a combination of segment portions 105 and 106 as shown in FIG. 5. Portions 105 and 106 are comprised of high m.m.f. per unit length materials such as samarium cobalt and ferrite respectively. The segment portion 105 having the highest energy product such as samarium cobalt is preferably positioned close to the load or the coil 30 to minimize flux leakage. An additional preferred design of magnetic element set 13, shown in FIG. 1. Utilizes a combination of different permanent magnetic materials having a high m.m.f. comprising element 14 of one magnetic material and element 15 of another material with a different energy product.

FIG. 5 shows an end view of the magnetic element set 94 at the front end of printhead 80 of FIGS. 4 and 4a. FIG. 5 also shows a sectionalized side view of a magnetic circuit 102 for retaining magnetic ink at printing tips 20 as an alternative to an inked ribbon. FIGS. 5a and 5b show detailed front and top views, respectively, of the magnetic circuit 102 comprising elements 103 and 104 of opposite polarity.

An advantage of this invention is that the mass of the print wire actuator including the print wire is reduced. Another advantage is that the moment of inertia of the actuator is minimized and the torque to inertia ratio is maximized. A further advantage is that extensive bending of the print wires is eliminated while having a large number of print wires closely packed for producing high quality print. Still another advantage is that high quality print is detained from a dot matrix printhead in a single pass relative to the paper web.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A dot matrix electromagnetic printing apparatus movable across a paper web supported by a platen comprising:

a plurality of elongated rectangular-shaped print wire actuators;

a print wire connected to each of said actuators, said print wire having a printing tip portion projecting beyond a first end of said actuator;

each of said print wire actuators including a rectangular-shaped current energizable coil for movement of said actuator in a first direction perpendicular to a corresponding magnetic field upon energization of said coil;

a support base;

a magnetic assembly comprising a plurality of magnetic element sets cooperating with said actuators each element set having a plurality of magnetic elements and being mounted on said support base;

selected ones of the elements of each of said element sets being spaced from each other to provide said magnetic field in a pair of thin elongated flux gaps therebetween for containing opposing sides of the coil of at least one of said print wire actuators;

said element sets being arranged for aligning each of said printing tip portions adjacent to one another and along at least one imaginary line;

said printing tip impacting a print position due to movement in said first direction, and said actuator moving in a second direction to return to a non-print position;

each of said actuators including means for supporting each of said actuators for movement of said printing tip portions in said first and second directions and for sustaining said impact at said print position;

each of said actuators being a thin elongated, planar rectangular shaped member, said coil being flat and generally rectangular;

said coil comprising two longitudinal coil portions, each of said coil portions arranged adjacent to the longitudinal sides of the actuator and linked by the magnetic flux path of said pole faces of opposite polarity;

each magnetic element set comprising at least one permanent magnet and first and second pole pieces each having a first face of a large surface area engaging the pole faces of the permanent magnet, the free end faces of the pole pieces perpendicular to said first face being positioned adjacent to the longitudinal side portions of the coil and being thin and having a small surface area to concentrate the magnetic flux in said pole pieces to said thin elongated flux gaps.

2. The printing apparatus of claim 1 wherein each of said print wire actuators include pivot means arranged on said actuator and lying within the region surrounded by said coil for pivotally mounting each actuator, the location of said pivot reducing the torque required for printing.

3. The apparatus of claim 1 wherein each actuator is mounted to pivot about a first axis;

each wire printing tip being positioned on said actuator substantially coincident with the center of percussion for said actuator pivotally about said first axis.

4. The apparatus of claim 3 wherein said actuator comprises supporting means positioned on said actuator substantially coincident with said first axis comprising:

a baseplate connected to said support base, and a support arm connected to said baseplate;

a fixed axle mounted on said support arm, and pivotal bearing means mounted on said fixed axle.

5. The apparatus of claim 4 wherein said actuator pivotal bearing means comprises:

a bobbin supporting said coil connected to said actuator, and said bobbin including a resilient portion comprising a central hub fixedly mounted on said fixed axle including at least one torsion spring portion;

said torsion spring portion comprising at least one flexual arm connecting said bobbin with said central hub, and said torsion spring portion positioned longitudinally on said bobbin.

6. The apparatus of claim 1 wherein each actuator supporting means includes first and second electrically conductive flexible support members with each member having first and second ends; and said coil having first and second electrical terminals; and wherein said first and second flexible support members being respectively connected to said first and second terminals at their first ends and to said supporting means at their second ends.

7. The apparatus of claim 6 wherein said first and second support members comprise substantially flat semicircular springs, each of said springs disposed in the same plane with said actuator between said coil and said supporting means.

8. The apparatus of claim 1 wherein said means for supporting said actuator printing tip portions comprises:

guide means having said print wires extending therethrough and supported thereby for guiding each of said wires;

said guide means comprising partitions having passages positioned to prevent each of said printing tip portions from buckling due to impacts experienced by said printing tips at said print position; and wherein said means for supporting said wire printing tips comprises a nose bearing having a straight guide channel for guiding each of said tips substantially straight and parallel;

said guide channels being adjacent to one another and arranged in at least one column along said common line and extending transversely of the direction of a line to be printed.

9. The apparatus of claim 1 wherein at least one of said magnetic elements of each of said sets comprises a permanent magnet having a high magnetomotive force per unit length, and each of said magnetic element sets being designed to operate at the magnetic flux density wherein the available external energy is at a maximum.

10. The apparatus of claim 9 wherein each permanent magnet segment is sandwiched between two magnetic soft metal pole pieces, each of said pole pieces having a pole face;

said magnetic element sets arranged with said elements having like pole faces adjacent to one another to eliminate magnetic flux leakage between adjacent flux fields, and said elements having like pole faces comprised of like magnet segment material.

11. The apparatus of claim 10 wherein said permanent magnet further comprise segment portions, each of said segment portions comprising a different magnetic material;

said segment portion having the highest energy product located nearest said pole faces to minimize flux leakage.

12. A dot matrix electromagnetic printing apparatus movable across a paper web supported by a platen comprising:

a plurality of print wire actuators;

a print wire connected to each of said actuators, said print wire having a printing tip portion projecting beyond a first end of said actuator;

a support base;

a magnetic assembly comprising a plurality of magnetic element sets each having a plurality of magnetic elements and being mounted on said support base;

the elements of each of said element sets being spaced from each other to provide a magnetic field in a narrow flux gap therebetween for containing at least one of said print wire actuators;

said element sets being arranged for aligning each of said printing tip portions adjacent to one another and along at least one imaginary line;

each of said print wire actuators including a current energizable coil for movement of said actuator in a first direction perpendicular to said corresponding magnetic field upon energization of said coil;

said printing tip impacting a print position due to movement in said first direction, and said actuator moving in a second direction to return to a non-print position;

means for supporting each of said actuators including each of said printing tip portions for movement in said first and second directions and for sustaining said impact at said print position;

means in said thin flux gap for transferring heat from said coil to said magnetic element sets thereby dissipating the heat generated by said coil;

said means comprising a liquid containing magnetic particles such that said liquid is retained in said thin flux gap by the action of said magnetic field on said particles;

said liquid and said particles comprising said heat transfer path between said coil and said magnetic element sets.

13. The apparatus of claim 1 wherein said magnetic assembly comprises at least one group of said magnetic element sets disposed in a common plane in a general radial array about said printing tips;

said thin elongated gaps being substantially parallel with their corresponding actuators which are stacked parallel to one another, said thin elongated gaps of adjacent magnetic elements sets substantially equally angularly spaced from one another;

resilient means for maintaining each of said deenergized actuators at said non-print position.

14. The apparatus of claim 13 comprising a group of four of said magnetic element sets;

said adjacent thin elongated flux gaps spaced perpendicular to one another;

said group comprising a plurality of said printing tip portions being substantially equal in length.

15. The apparatus of claim 13 wherein said magnetic assembly comprises a first group and a second group of magnetic element sets disposed further than the first group from the nose bearing slidably supporting the printing tips of said print wires;

each of said first and second groups comprising four magnetic element sets;

said thin elongated flux gaps of said first group adjacent to said thin elongated flux gaps of second group being parallel to one another;

said printing tips being aligned adjacent to one another and closely packed in a matrix of rows and at least one column.

16. The apparatus of claim 13 wherein each of said groups comprises a pair of said magnetic element sets with each of said pairs arranged opposite one another;

said groups being parallel and adjacent to one another having all of said thin elongated gaps disposed in a common plane with successive ones of said groups disposed progressively further from said printing tips of said print wires;

said printing tips aligned adjacent to one another and closely spaced in a matrix of rows and at least one column.

17. The apparatus of claim 1 wherein said planar actuator comprises a pair of thin sheets of insulation laminated to one another and having voids along the longitudinal portions of both sides of said coil and including at least one hole positioned along the longitudinal axis of said actuator for enhancing heat dissipation.

18. The apparatus of claim 17 wherein said lamination comprises high temperature polyimide insulation.

19. The apparatus of claim 1 further retaining means positioned at said printing tips for retaining ink for printing.

20. The apparatus of claim 19 wherein said retaining means comprises a magnetic circuit and said ink is magnetic ink.

21. An actuator for use in dot matrix printing comprising:

a bobbinless coil surrounding an elongated hollow rectangular shaped region having two long parallel sides and two short parallel sides;

said coil having two long sides extending along the two long sides of said hollow region and two short sides extending along the short sides of the hollow region, and being curved where the long and short side are joined;

said coil being laminated between a pair of thin sheets of insulation material, the coefficient of thermal expansion of said insulation material substantially matching that of the coil conductive material to eliminate thermally induced mechanical stress between the coil and the laminate;

said pair of thin sheets being laminated to one another in said hollow region;

a print wire having a mounting end laminated between said thin sheets adjacent to one short side of said coil and a free end forming a printing tip extending away from said actuator;

a pivot mounting laminated between said thin sheets in the hollow region surrounded by said coil and adjacent the other one of the short sides of said coil;

a pair of spring mounting members each having a first ends electrically coupled to said coil and laminated between said thin sheets adjacent to the said other one of said short sides of the coil and extending away from said coil for electrical connection to a driving source.

22. The actuator of claim 21 wherein the thickness of said actuator is of the order of 0.014 inches.

23. The actuator of claim 21 wherein said spring mounting members each comprise resilient conductive members having a substantially U-shaped central portion having a first end laminated between said thin sheets and having a second end serving as an electrical terminal.

24. The actuator of claim 23 further comprising a mounting means for mounting the second ends of said conductive spring members to a support, said springs normally biasing the end of the associated actuator containing said printing tip away from the printing position.

25. The actuator of claim 24 wherein only the first ends of the springs adjacent to the U-shaped position of said springs are laminated between said first and second insulation sheets to enable the spring members to freely flex when the actuator is moved during a printing operation.

26. The actuator of claim 21 wherein openings are provided in laminated sheets in said hollow region to further reduce the mass and inertia of the actuator and to increase the heat dissipation of the actuator during operation.

* * * * *

UNITED STATES PATENT AND TRADEMARK OFFICE

CERTIFICATE OF CORRECTION

PATENT NO. : 4,493,568

DATED : January 15, 1985

INVENTOR(S) : David A. Estabrooks

It is certified that error appears in the above-identified patent and that said Letters Patent is hereby corrected as shown below:

Column 4, line 64 after "movable" insert --along member M (see Fig. 1) in a direction perpendicular to the plane of Fig. 5c and--.

Column 8, line 63 change "press" to --pass--.

Column 9, line 46 change "Fig. 1. Utilizes" to --Fig. 1, utilizes--.

Column 9, line 66 change "detained" to --obtained--.

Claim 19, line 1 before "retaining" insert --comprising--.

Signed and Sealed this

*Third* Day of *September 1985*

[SEAL]

*Attest:*

DONALD J. QUIGG

*Attesting Officer* *Acting Commissioner of Patents and Trademarks - Designate*